US007247391B2

(12) United States Patent
Nissinen et al.

(10) Patent No.: US 7,247,391 B2
(45) Date of Patent: Jul. 24, 2007

(54) METHOD OF PRODUCING A COATED FIBROUS WEB

(75) Inventors: Kirsi Nissinen, Vilppula (FI); Petri Silenius, Lohja as. (FI)

(73) Assignee: M-real Oyj, Espoo (FI)

( * ) Notice: Subject to any disclaimer, the term of this patent is extended or adjusted under 35 U.S.C. 154(b) by 133 days.

(21) Appl. No.: 10/478,744

(22) PCT Filed: Jun. 25, 2002

(86) PCT No.: PCT/FI02/00558

§ 371 (c)(1),
(2), (4) Date: Nov. 25, 2003

(87) PCT Pub. No.: WO03/000993

PCT Pub. Date: Jan. 3, 2003

(65) Prior Publication Data

US 2004/0149406 A1 Aug. 5, 2004

(30) Foreign Application Priority Data

Jun. 25, 2001 (FI) ..... 20011355

(51) Int. Cl.
*B32B 5/16* (2006.01)

(52) U.S. Cl. ..... 428/537.5; 428/532; 428/536

(58) Field of Classification Search ..... 428/537.5, 428/532; 162/123; 427/205; 118/101
See application file for complete search history.

(56) References Cited

U.S. PATENT DOCUMENTS 6,022,448 A * 2/2000 Eriksson et al. ..... 162/123

FOREIGN PATENT DOCUMENTS

EP 0 942 099 A2 9/1999
EP 0942099 * 9/1999

* cited by examiner

*Primary Examiner*—Leszek Kiliman
(74) *Attorney, Agent, or Firm*—Kubovcik & Kubovcik

(57) ABSTRACT

The present invention concerns a method of producing a calendered, coated fibrous web, according to which method a fibrous web is coated with a coating colour containing a coating pigment, and the coated fibrous web is calendered. According to the invention, at least 1%, preferably 10 to 100% of the weight of the pigment comprises calcium oxalate, and calendering the coated web by online calendering. The properties of the calcium oxalate pigment are so advantageous for calendering that it is possible to obtain a reasonably high gloss already with a machine calender (online calendering), which will eliminate need for a separate offline calender in the production line of matt surface papers.

9 Claims, 3 Drawing Sheets

METHOD OF PRODUCING A COATED FIBROUS WEB

The present invention relates to a method in accordance with the preamble of claim 1 of producing a calendered, coated fibrous web.

According to a method of the present kind, a fibrous web is coated with a coating colour containing a coating pigment, and the coated fibrous web is calendered.

There is a constant need for printing papers having improved surface properties. In particular, the coated papers used for printing, such as fine papers, should have a very smooth surface with very little roughening. Conventionally, such a surface is obtained by strong calendering of the coated paper web. Unfortunately, calendering also reduces mechanical properties and impairs opacity; i.e. calendered paper tends to be more brittle and not as opaque as uncalendered. Furthermore, in printed matter used for modern advertising purposes, the printed features are often distinguished from the paper background by a distinct difference between the gloss of the print and of the paper (a difference known as "delta gloss"). The greater the difference, the more striking is the effect of the printed matter. Usually, both the gloss and the delta gloss are dependent on the degree of calendering.

High-quality papers are coated with coating colours comprising mineral pigments, such as calcium carbonate (ground or precipitated) and kaolin. For achieving glossy surfaces, synthetic polymer pigments are also used.

In our earlier patent application (published EP Patent Application No. 0 942 099) we have shown that calcium oxalate can be used as a pigment and a filler for paper webs having high brightness and good opacity. Calcium oxalate is practically insoluble in water. It has excellent optical properties and causes less wear of the wire than other pigments commonly in use. Further, calcium oxalate gives less ash than other pigments upon combustion. This enables the utilization of waste paper e.g. in energy production.

The production of calendered papers was not studied in our earlier patent application.

It is an aim of the present invention to provide a technical solution for producing papers simultaneously exhibiting high smoothness, good opacity and brightness and excellent delta gloss.

In connection with the present invention we have found that the surface properties of calendered paper can be considerably improved by means of a calcium oxalate coating layer. Surprisingly it was noticed that even if the roughness of a paper coated with a pigment which at least partially comprises calcium oxalate is small and the gloss is high already before calendering, during calendering the roughness of calcium oxalate coated papers decreases to a value as low as 1.4 to 1.5 μm, whereas it almost twice as high (2.2 to 2.7 μm) for papers coated with kaolin. Furthermore, a very important and equally surprising finding shows that up to a certain degree of calendering, calcium oxalate coated papers attain an increased opacity by calendering. Based on all prior experiences on pigments and calendering, this finding was totally unexpected: as mentioned above calendering is known to reduce opacity, which is one of the main disadvantages of calendering. By using calcium oxalate it now becomes possible up to a moderate degree of calendering to improve opacity.

The properties of the calcium oxalate pigment are so advantageous for calendering that it is possible to obtain a reasonably high gloss already with a machine calender (online calendering), which will, in some instances, do away with the need for a separate offline calender in the production line of certain paper qualities, such as matt surface papers (silk qualities).

Based on the above findings, the invention resides in the concept of using for the preparation of a calendered paper or cardboard a coating pigment a part of which, in particular at least 1% of which, is comprised of calcium oxalate, and calendering the coated web by online calendering. Optionally, the online calendered web can be further calendered by offline coating, e.g. in a supercalender.

More particularly, the present invention is mainly characterized by what is stated in the characterized part of claim 1.

The invention provides considerable advantages, some of which were discussed above already. Our tests have showed that the smoothness of uncalendered paper webs are on the order of 2.8 to 2.9 μm whereas uncalendered samples coated with GCC (ground calcium carbonate) coating colours had a roughness of some 4.4 to 4.8 μm. This considerable difference opens up a possibility of producing a ready surface without extensive calendering, e.g., as mentioned above, by only calendering with an online machine calender. This will lead to a potential reduction in investment costs of calenders. Furthermore, it will become possible to avoid extensive calendering which will impair opacity.

The gloss of papers coated with calcium oxalate is clearly better than that of papers coated with GCC. Calendering will even further enhance the difference: the gloss of calendered oxalate-coated papers is up to three times better than that of GCC-coated papers. The gloss is essentially not influenced by the amount of coating. Thus, e.g. the gloss of slightly calendered calcium oxalate samples was about 25% whereas the gloss of corresponding GCC samples was only about 8%.

Printing tests have shown that a calcium oxalate coating is capable of providing a surface, which exhibits high gloss of the printed pattern. The superiority of the gloss of a calcium oxalate coating compared to a GCC coating is apparent from a comparison of the print gloss: the print gloss obtained by calcium oxalate at a printing density of D 1.6 was, in our tests, over 60%, whereas GCC gas slightly less than 35%.

Above, calcium oxalate was compared to ground calcium carbonate. It should be noted, however, that calcium oxalate can also replace clay in coating colours where clay is typically used in combinations with PCC: a coating mixture of PCC and calcium oxalate provides papers having better opacity, brightness, and scattering coefficient values than a mixture of PCC and clay. The paper gloss values of both mixtures are similar. Once again, in the printing tests calcium oxalate gave the best delta gloss values. The delta gloss of PCC and calcium oxalate coated paper was 2 to 3 times better than for papers coated with a mixture of PCC and clay.

Next, the invention will be examined in more detail with the aid of a detailed description with particular reference to the below examples and the attached drawings.

FIG. 1 shows the results of roughness measurements at different gloss levels for paper samples coated with nine different coating colours including coating colour comprising calcium oxalate as the sole pigment and mixtures of conventional pigments and calcium oxalate; papers coated with GCC, PCC and kaolin and mixtures thereof were used for reference FIG. 2 shows the opacity of the same nine samples at different gloss levels;

Figure 1:
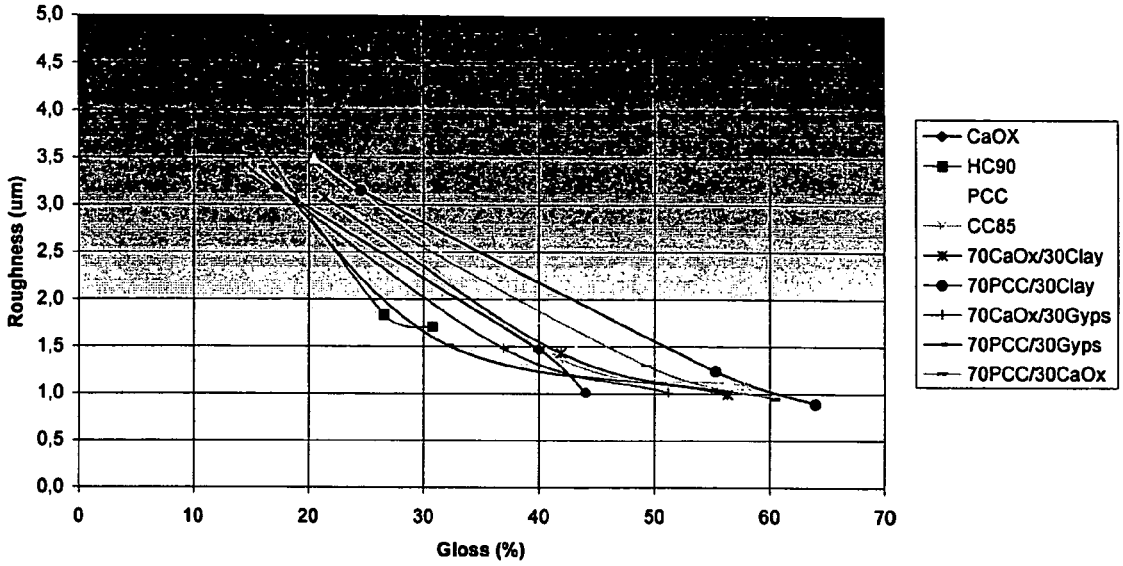

The chemical structure of calcium oxalate is $$Ca(OOC)_2 \quad (I)$$

Usually, it is present in hydrated form, having the brutto formula $$CaC_2O_4 \times nH_2O \quad (II)$$

wherein n is usually 1 or 2, generally 1 (monohydrate).

In nature, it can be found in many plant cells and, e.g., in uroliths and kidney stones. As a pure substance it is generally classified as a laboratory chemical and it has been used for analytical purposes for determining calcium.

Usually calcium oxalate is considered a problem in the paper and pulp industry. It causes scaling, in particular in bleach plants for both kraft and mechanical mills, and in sulphite pulping mills. Calcium oxalate depositions hinder the normal plant operation and decrease the quality of paper produced by increasing the dirt count. Calcium oxalate originates from oxalic acid present in the wood or formed by oxidation processes during pulping or bleaching; and calcium, which can also be present in the wood or enter the system in the process water.

On the other hand, the oxalic acid in wood presents an interesting raw material for commercial production of calcium oxalate. Thus, oxalic acid can be produced at a high yield of about 16% from black liquor by heating with an alkaline agent. Oxalic acid is also formed in the sulphite process and is provided as a concentrate. These oxalic acid sources can be exploited either by providing oxalic acid separator or by precipitating oxalic acid with lime or lime sludge and liquefying oxalic acid. Lime can be obtained from the lime sludge reburning kiln.

Calcium oxalate is also commercially available as a laboratory chemical.

According to the present invention, a fibrous web comprising a cellulosic material is coated with a coating colour comprising at least partially calcium oxalate as a pigment and then the coated web is subjected to online calendering.

The term "cellulosic material" denotes paper or board or a corresponding cellulose-containing material, which is derived from a lignocellulosic raw material, in particular from wood or from annual or perennial plants. Said material can be wood-containing or wood-free (LWC, SC, coated printing papers and fine papers) and it can be produced from mechanical, semi-mechanical (chemi-mechanical) or chemical pulp. The pulp can be bleached or unbleached. The material can also contain recycled fibres, in particular reclaimed paper or reclaimed board. Typically, the grammage of the material web lies in the range of 35 to 500 g/m$^2$.

Calcium oxalate can be formulated into suitable coating colours and used in that form for coating of the fibrous web. In the present invention "coating colour" means a composition designed for the coating or surfacing of paper or board, containing water and components known per se, such as pigments, binding agent and a component regulating the viscosity (a thickening agent). In addition to calcium oxalate, the following pigments can be used: calcium carbonate, calcium sulphate, aluminium silicate, kaolin (aluminium silicate containing cristallization water), aluminium hydroxide, magnesium silicate, talc (magnesium silicate containing cristallization water) titanium oxide and barium sulphate and mixtures of these. Also synthetic pigments may be employed. Primary pigments of those mentioned above are calcium oxalate, kaolin and/or calcium carbonate and/or gypsum, usually amounting to over 50% of the dry matter of the coating composition.

Calcinated kaolin, titanium oxide, precipitated carbonate, satin white, aluminium hydroxide, sodium silica aluminate and plastic pigments are additional pigments and the amounts of these are usually below 25% of the dry matter content of the mixture. Special pigments to be mentioned are special kaolins and calcium carbonates and barium sulphate and zinc oxide.

The coating colours may contain 1 to 100 wt-% calcium oxalate, in particular 10 to 100 wt-%, preferably 20 to 99 wt-% and for example about 25 to 95 wt-% (calculated from the total weight of the pigment present in the coating colour). In mixtures with other primary pigments, calcium oxalate makes up 1 to 90 parts, preferably 10 to 90 parts, and kaolin and/or calcium carbonate (including PCC) and/or gypsum stand for 10 to 99 parts, preferably 10 to 90 parts, the total pigment making up 100 parts.

Any binding agent know per se, which is frequently used for manufacturing paper, can be used as a binder. In addition to individual binders it is also possible to use mixtures of binding agents. As specific examples of typical binding agents the following can be mentioned: synthetic latex-type binders consisting of polymers or copolymers of ethyleneically unsaturated compounds, such as butadiene-styrene type copolymers which can contain a comonomer with a carboxylic group, such as acrylic acid, itaconic acid or maleic acid, and poly(vinyl acetate) which contains comonomers having carboxylic groups. In combination with the afore-mentioned substances e.g. water-soluble polymers, starch, CMC, hydroxy ethyl cellulose and poly(vinyl alcohol) can be used as binders.

In the coating mixture there can further be used conventional additives and auxiliary agents, such as dispersing agents (e.g. sodium salt of poly(acrylic acid)), substances for adjusting the viscosity and water rentention of the mixture (e.g. CMC, hydroxyethyl cellulose, polyacrylates, alginates, benzoate), lubricating agents, hardeners for improving the water resistance, optical agents, anti-foaming agents and substances for regulating the pH and for preventing product degradation. The lubricating agents include sulphonated oils, esters, amines, calcium and ammonium stearates; the agents improving water resistance include glyoxal; optical agents include diaminostilben and derivatives of disulphonic acid; the anti-foaming agents include phosphate esters, silicones, alcohols, ethers, vegetable oils, the pH-regulators include sodium hydroxide and ammonia; and, finally, the anti-degradation agents include formaldehyde, phenol and quaternary ammonium salts.

The coating compositions according to the present invention can be used both as pre-coat mixtures and as surface coating colours. For 100 parts by weight of pigment the coating colour typically contains about 0.1 to 20 parts by weight of the thickening agent and 1 to 20 parts by weight of a binder.

The composition of a typical pre-coat mixture is the following:

| | |
|---|---|
| pigment/filler (calcium oxalate optionally together with some other pigment) | 100 parts by weight |
| thickener | 0.1 to 2.0 parts by weight |
| binder | 1 to 20 parts by weight |

-continued

| | |
|---|---|
| additives | 0.1 to 10 parts by weight |
| water | balance |

The composition of a surface coating colour according to the present invention is, for example, the following:

| | |
|---|---|
| pigment/filler I (calcium oxalate) | 30 to 90 parts by weight |
| optionally a second pigment/filler II (e.g. fine kaolin and/or carbonate and/or gypsum | 10 to 30 parts by weight |
| total pigment | 100 parts by weight |
| thickener | 0.1 to 2.0 parts by weight |
| binder | 1 to 20 parts by weight |
| additives | 0.1 to 10 parts by weight |
| water | balance |

The total amount of a coating applied on both sides of the web is typically about 2 to 100 g/m$^2$, preferably about 3 to 80, in particular about 5 to 40 g/m$^2$ a side.

The coating colour can be applied on the material web in a manner known per se. Thus, the coating can be carried out on-line or off-line by using a conventional coater, i.e. a doctor blade coater, or by film press coating or by spray coating (surface spraying). It is possible to prepare a double-coated or triple-coated web by carrying out the first coating by the film press method and the other coating(s) by blade coating. The aimed coating amount is, for example, in precoating 1 to 15 g/m$^2$ and in surface coating 3 to 30 g/m$^2$ per side. The coating weights have been calculated from the dry matter of the coating.

As the examples below show, particularly interesting results are obtained when the fibrous web is coated with a coating composition with a pigment comprising a mixture of precipitated calcium carbonate and calcium oxalate, wherein the precipitated calcium carbonate forms the majority of the pigment. There appears to be a synergy of action between calcium oxalate and PCC which gives rise to a coating colour with quite good brightness. Preferably the pigment of such a coating colour comprises 55 to 80% precipitated calcium carbonate and 20 to 45% calcium oxalate of the total weight of the pigment.

A web coated in the manner described above is thereafter directed to online calendering. By online calendering is, in the present case, meant calendering carried out in connection with the paper or cardboard machine, without intermediate reeling of the paper. The online calendered web can be further subjected to offline calendering.

According to a preferred embodiment, the fibrous web is calendered with an online soft calender. By soft-calendering is meant calendering in which at least one of the two rolls forming a nip has a soft coating. The linear pressure in the calendering is generally at least 200 kN/m and the speed of the calendering is at least 800 m/min.

As known in the art, the gloss of a paper or board product can be affected significantly by the linear pressure and temperature of calendering. If the gloss of papers is above approx. 40-50% (Hunter gloss, 75°), they are called glossy papers. The calendering process is in that case usually so-called supercalendering, although there are also other, less often used options, e.g., for boards. If the gloss of papers is below 40-50%, they are called matt, silk or satin papers. According to whether glossy paper or matt paper is aimed at, the surface material of the calender rolls and the calender process conditions, above all the roll temperatures and the linear pressure, but possibly also the calender speed and steaming, are set at different values. While with glossy paper the aim in principle is to achieve as high a gloss as possible, matt paper is above all desired to be very smooth, but so that the structure of the surface will not reflect light in the manner of glossy paper.

In general, glossy paper products are obtained when calendering is carried out at a high linear pressure and a high temperature (e.g. approx. 120-170° C.). The gloss of these products is over 50%. The paper web is calendered in this case in an online calender having at least two nips formed between a hard roll and a soft roll. The linear pressure in the calendering of paper is, for example, approx. 250-450 kN/m.

According to another preferred embodiment, the fibrous web is online calendered with a linear pressure of 75 to 350 kN/m. The fibrous web is calendered to obtain a final roughness of less than 3.5 μm.

For producing a matt surface paper, the fibrous web is online calendered to obtain a gloss of 30 to 40%. For producing a glossy surface, the fibrous web is offline calendered to obtain a gloss of at least 60%.

The temperature of the coated paper web arriving at the calender is, when paper making, calendering and calendering are in the same line, in general, the fibrous web is online calendered at a temperature in the range of 40 to 250° C., preferably 40 to 75° C. The temperature at the beginning of the calendering can be, for example, approx. 50-60° C. According to another embodiment of the invention, the calender rolls are not substantially heated; the initial temperature of the paper web is exploited in this embodiment. This alternative is suitable for the production of matt papers, in which case a calendered paper web having a gloss below 50% is produced. The paper web is in this case calendered at a linear pressure of, for example, 200-350 kN/m.

With the help of the invention it is possible to produce coated and calendered material webs having excellent printing properties, good smoothness, and high opacity and brightness. Especially preferred products include coated printing papers in which high gloss and high opacity and bulk are combined. The roughness of the calenered web is usually less than 3.5 μm. The grammage of the material web may be 50-450 g/m$^2$. In general the grammage of the base paper is 30-250 g/m$^2$, preferably 30-80 g/m$^2$. By coating a base paper of this type, which has a grammage of approx. 50-70 g/m$^2$, with 10-20 g of coating/m$^2$/side and by calendering the product there is obtained a product having a grammage of 70-110 g/m$^2$, a brightness of at least 90%, an opacity of at least 90%, and a surface roughness of at maximum 1.3 μm in glossy paper and at maximum 2.8 μm in matt paper. The gloss obtained for a (offline-calendered) glossy paper is in excess of 50%, typically up to 65% (Hunter 75).

According to a preferred embodiment calcium oxalate is used as a pigment of silk papers. It can be used as such or in mixture with one or several of kaolin, PCC and gypsum, the conventional pigments making up a maximum of 80%, preferably 60% or less of the pigment. In the present context silk papers are papers having a gloss of about 30 to 50% (conventionally maximally 40%). With the present invention this level of gloss can be obtained even with exclusively online calendering.

The opacity of papers coated with calcium oxalate pigments is generally over 95% and an ISO brightness level of 92% can be reached.

The following non-limiting examples illustrate the invention. The light-scattering coefficients, light-absorption coefficients and opacities have been determined by the standard SCAN 8:93. ISO brightness (R457) has been determined according to standard SCAN-P 3:93. The grammage of the sheets and their thicknesses are determined according to standards SCAN-P 6:75 and SCAN-P 7:75, respectively.

EXAMPLE 1

Preparation of Coating Colour

The coating colour formulation was same on all pigments and pigment mixtures. Here is the used formulation:

100 part of pigment
12 part of latex (SB40)
0.9 part of CMC (ff-10)
1 part of Blancophor psf The results from viscosity measurements are presented in Table I. The results show that lowest viscosities were measured from PCC, CaOx/PCC, CaOx/Clay and CaOx coating colours. An explanation of the abbreviations is given below under the table.

Water retention values are best in CaOx, CaOx/Clay, CaOx/Gypsum and PCC/Clay coating colour. All together the values from viscosity and water retention tests did not vary a lot and they all were in an acceptable level.

TABLE I

Results of viscosity measurements of various coating colours

| Sample point | Pigments in coating colour | Dry content | pH | Brookfield 50 | Brookfield 100 | Water retention ($g/m^2$) |
|---|---|---|---|---|---|---|
| 1 | 100 CaOx | 66.0 | 8.6 | 3200 | 1980 | 70–60 |
| 2 | 100 HC90 | 65.7 | 8.6 | 4560 | 2740 | 100.6 |
| 3 | 100 PCC | 65.8 | 8.5 | 2890 | 1690 | 122.9 |
| 4 | 100 CC85 | 65.9 | 8.4 | 4060 | 2480 | 104.3 |
| 5 | 70 CaOx/30 Clay | 64.7 | 8.6 | 3200 | 1960 | 73.9 |
| 6 | 70 PCC/30 Clay | 66.0 | — | 4000 | 2320 | 81.2 |
| 7 | 70 CaOx/ 30 Gypsum | 65.1 | 8.7 | 3920 | 2440 | 75.8 |
| 8 | 70 PCC/ 30 Gypsum | — | — | — | — | — |
| 9 | 30 CaOx/70 PCC | 66.9 | 8.6 | 2960 | 1800 | 105.5 |

"PCC" stands for precipitated calcium carbonate, "CaOx" for calcium oxalate, "CC" for ground calcium carbonate, and "HC90" for a ground calcium carbonate quality supplied in the form of an aqueous slurry.

Coating and Calendering

The coating tests were made in Helicoater. The base paper in coating trials was from Kangas mills ~56 g/m2 paper (furnish: 60% CTMP and 40% softwood pulp). The coating colour amount was 13 $g/m^2$. After the coating some calendering tests were made to get the knowledge of coating colours glossing potential. The gloss from samples was measured before calendering and after every calendering nip (6 nips). These calendering tests were made in four different conditions:

1. Nip pressure 100 kN/m, temperature 25° C.
2. Nip pressure 100 kN/m, temperature 60° C.
3. Nip pressure 300 kN/m, temperature 25° C.
4. Nip pressure 300 kN/m, temperature 60° C.

A summary of the gloss results is given in Table II. Particularly interesting results are obtained at 60° C. The calcium oxalate coating colour will become glossy upon warming and the total gloss level after six nips at 60° C. (300 kN/m) was 63%. In the same conditions the best gloss was obtained with a CaOx/Clay coating colour (76%), the second best with a PCC/CaOx coating colour (73%), and the third best with a PCC coating (71%).

TABLE II

The coated papers gloss after six nips

| Calendering | CaOx (%) | HC90 (%) | PCC (%) | CC85 (%) | 70 CaOx/30 Clay (%) | 70 PCC/ 30 Clay (%) | 70 CaOx/ 30Clay (%) | 30 CaOx/ 70PCC (%) |
|---|---|---|---|---|---|---|---|---|
| 100 kN/m, 25° C. | 31 | 31 | 56 | 53 | 61 | 64 | 54 | 61 |
| 300 kN/m, 25° C. | 41 | 35 | 62 | 61 | 68 | 66 | 52 | 65 |
| 100 kN/m, 60° C. | 58 | 49 | 75 | 72 | 74 | 76 | 62 | 74 |
| 300 kN/m, 60° C. | 63 | 51 | 71 | 70 | 76 | 70 | 61 | 73 |

Other measured properties from samples were roughness, opacity, CIE L*, scattering coefficients. The results from these measurements are presented as a function of paper gloss in FIGS. 1 to 5.

FIG. 1 shows the results from the roughness measurement. As can be noted, the best roughness values at a 40% gloss are obtained with PCC/gypsum, CaOx/gypsum and CaOx coatings. The corresponding good coatings at a 50% gloss are CaOx/gypsum, PCC/CaOx, PCC/gypsum and CaOx/clay.

Figure 2:
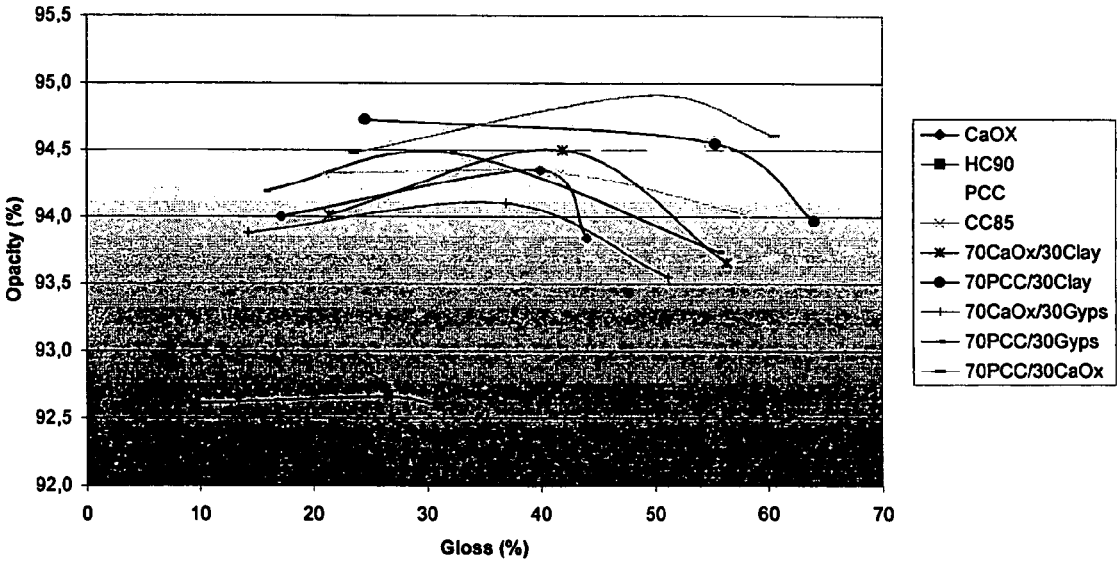

FIG. 2 gives the results of opacity measurements. The results show that all calcium oxalate coatings have a tendency to provide paper with better opacity after calendering to a certain level. This behaviour can be seen from CaOx, CaOx/Clay, CaOx/gypsum and PCC/CaOx coatings.

Figure 3:
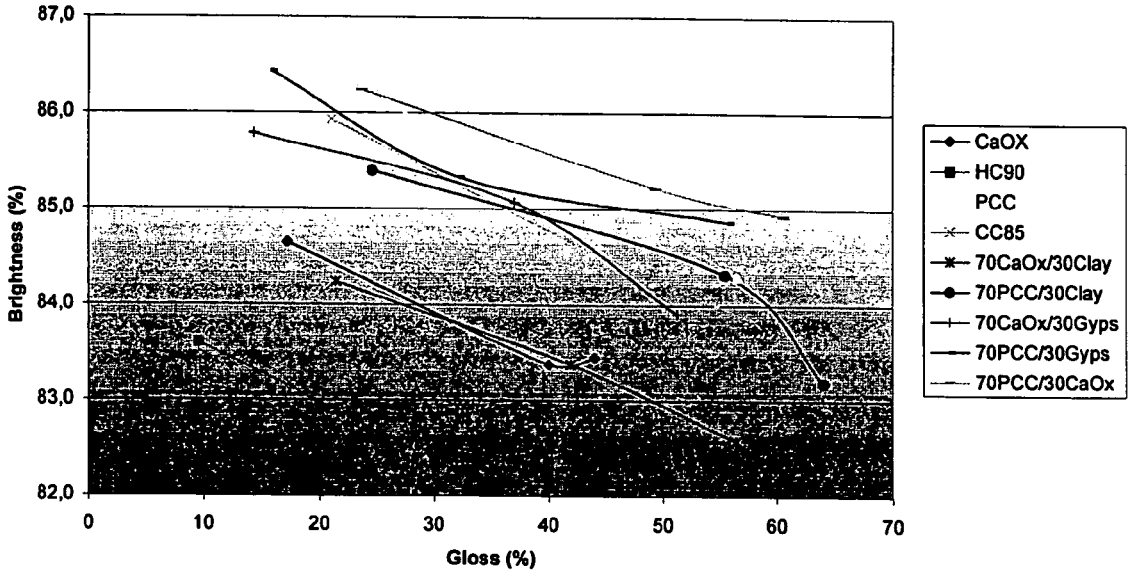
FIG. 3 shows the brightness of the samples at different gloss levels.

FIG. 3 depicts the result of brightness measurements. The curves show that the highest values are obtained with PCC/CaOx coatings. Also PCC and PCC/gypsum coatings give high brightness values. The difference between PCC/CaOX and PCC/Clay coatings was about 1 unit. The brightness of PCC/CaOx is interesting because with pure calcium oxalate coating the brightness is quite low but together with PCC calcium oxalate coating gives good brightness. This feature may be due to the packing tendency of PCC and calcium oxalate so that the light scatters better when pigments are together than individually, but this is only one possible explanation.

Figure 4:
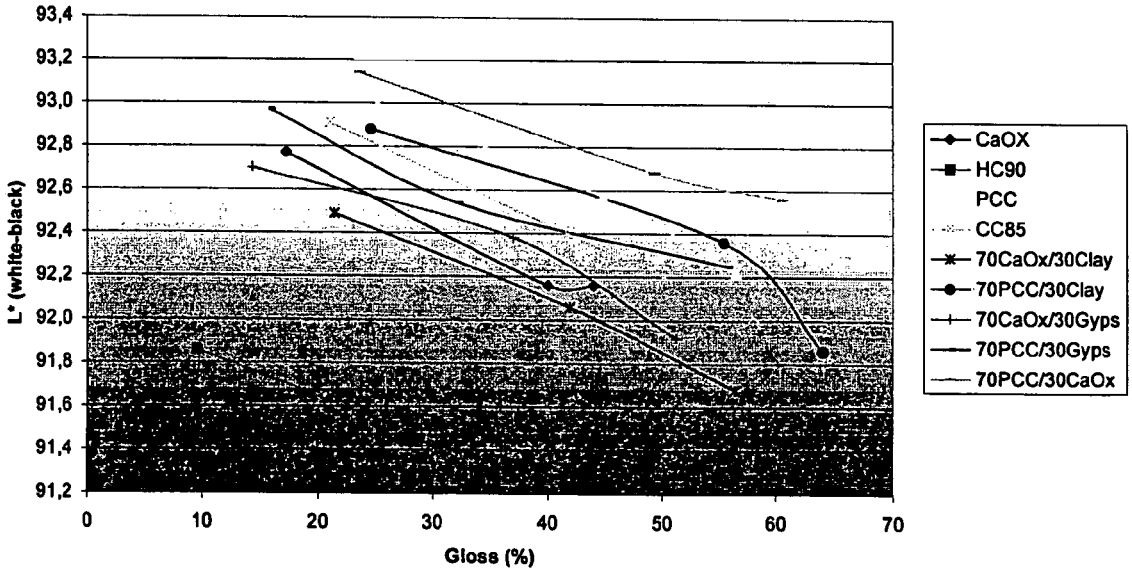
FIG. 4 shows the L*-values at different gloss levels.

In FIG. 4 a similar kind of behaviour as in FIG. 3 can be seen.

Figure 5:
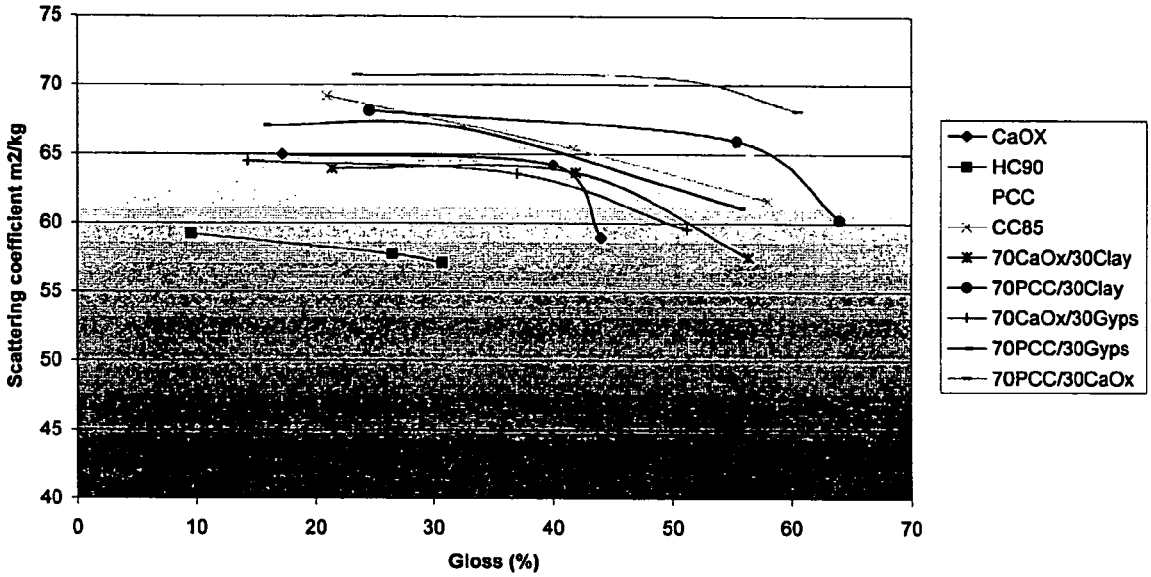
FIG. 5 shows the scattering coefficient at different gloss levels.

FIG. 5 indicates the results of scattering coefficient measurements. The highest scattering coefficient value was obtained with PCC coating. At paper gloss values in excess of 45% the highest scattering coefficient value is obtained with PCC/CaOx coating.

EXAMPLE 2

Figure 6:
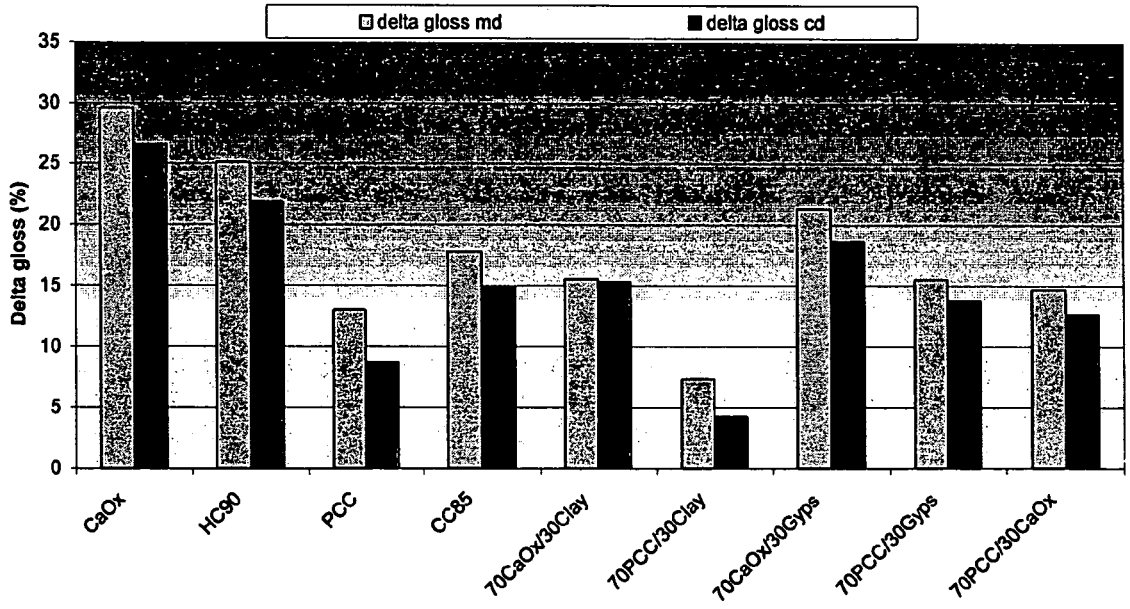
FIG. 6 shows the delta gloss in machine and in cross direction.

Printing Tests/IGT: Picking Resistance, Print and Set-Off Density and Print Gloss The aim of the printing tests was to compare the printability of papers with different pigment and pigment mixtures. The print gloss was measured and the delta gloss values (=printed gloss−paper gloss) of different coatings are presented in FIG. 6.

The results shows that CaOx, HC90 and CaOx/gypsum coated papers have good delta gloss values, around 20 . . . 30%. Interesting is also to compare PCC/clay papers values to PCC/CaOx values and to notice that PCC/CaOx coated papers have 2 to 3 times better delta gloss values.

The invention claimed is:

1. A method of producing a calendered, coated fibrous web, according to which method a fibrous web is coated with a coating composition containing a pigment which comprises 55 to 80% precipitated calcium carbonate and 20 to 45% calcium oxalate based on the total weight of the pigment, and the coated fibrous web is calendered, characterized by calendering the coated web by online calendering.

2. The method according to claim 1, wherein the fibrous web is calendered with an online soft calender.

3. The method according to claim 1, wherein the fibrous web is online calendered with a linear pressure of 75 to 500 kN/m, preferably less than 350 kN/m.

4. The method according to claim 1, wherein the fibrous web is online calendered at a temperature in the range of 40 to 250° C., preferably 40 to 75° C.

5. The method according to claim 1, wherein the fibrous web is calendered to obtain a final roughness of less than 3.5 mm.

6. The method according to claim 5, wherein the fibrous web is online calendered to obtain a gloss of 30 to 50%.

7. The method according to claim 5, wherein the fibrous web is offline calendered to obtain a gloss in excess of 50%.

8. The method according to claim 1, wherein on at least one surface, preferably both surfaces, of the fibrous web there is formed a coating layer having a grammage of 2-30 g/m2/side.

9. A silk paper comprising an online calendered paper having a gloss of 30 to 50% and containing calcium oxalate as a coating pigment.

* * * * *